United States Patent [19]

Rezanka et al.

[11] 4,279,499

[45] Jul. 21, 1981

[54] ELECTROPHOTOGRAPHIC CLEANING APPARATUS

[75] Inventors: Ivan Rezanka, Pittsford; Nero R. Lindblad, Palmyra, both of N.Y.

[73] Assignee: Xerox Corporation, Stamford, Conn.

[21] Appl. No.: 72,263

[22] Filed: Sep. 4, 1979

[51] Int. Cl.[3] ..... G03G 21/00; G03G 15/00

[52] U.S. Cl. ..... 355/15; 355/3 DD

[58] Field of Search ..... 355/3 R, 3 DD, 15; 430/125

[56] References Cited

U.S. PATENT DOCUMENTS

| | | | |
|---|---|---|---|
| 3,926,517 | 12/1975 | Nagahara | 355/15 X |
| 4,043,298 | 8/1977 | Swackhamer | 355/15 X |
| 4,110,034 | 8/1978 | Suzuki | 355/15 |
| 4,142,165 | 2/1979 | Miyakawa et al. | 355/15 X |

*Primary Examiner*—Fred L. Braun

[57] ABSTRACT

A magnetic brush cleaning apparatus which includes a magnetic brush roll having a plurality of magnets mounted therein, a reservoir for carrier particles closely spaced from the magnetic brush roll, a pickoff for removing a part of the carrier particles constituting the magnetic brush during the rotation of the magnetic brush roll, and an exit at the lower end of the reservoir for directing the carrier particles onto the magnetic roll, so that the reservoir, the pickoff, the exit and the magnets cooperate to cause the circulation of carrier particles between the magnetic brush roll and the reservoir whereby a portion of the magnetic brush is continuously removed and reformed during the rotation of the magnetic brush roll. In another embodiment, the reservoir, the pickoff and the exit are used only during servicing of the cleaning device.

3 Claims, 2 Drawing Figures

ELECTROPHOTOGRAPHIC CLEANING APPARATUS

BACKGROUND OF THE INVENTION

This invention relates to electrostatographic imaging systems and, more particularly, to an improved apparatus for cleaning electrostatographic imaging surfaces.

In the practice of xerography as described in U.S. Pat. No. 2,297,691 to Chester F. Carlson, a xerographic surface comprising a layer of photoconductive insulating material on a conductive backing is used to support electrostatic images. In the usual method of carrying out the process, the xerographic plate is electrostatically charged uniformly over its surface, and then exposed to a light pattern of the image being reproduced to thereby discharge the charge in the areas where light strikes the layer. The undischarged areas of the layer thus form an electrostatic charge pattern or latent electrostatic image in conformity with the configuration of the original pattern.

The latent electrostatic image is developed by contacting it with a finely divided electrostatically attractable material, such as a resinous powder. The powder is held in the image areas by the electrostatic fields on the layer. Where the field is greatest, the greatest amount of material is deposited, and where the field is least, little or no material is deposited. Thus, a powder image is produced in conformity with the image of the original being produced. The powder image is subsequently transferred to a sheet of paper or other transfer member, and suitably affixed thereto to form a permanent copy.

After the powder image is transferred, some residual toner usually remains on the imaging surface. The removal of all or substantially all of such residual toner is important to high copy quality since unremoved toner may appear as the background in the next copying cycle. The removal of the residual toner remaining on the imaging surface after the transfer operation is carried out in a cleaning operation.

In present day commercial automatic copying and duplicating machines, the electrostatographic imaging surface, which may be in the form of a drum or belt, moves at high rates in timed unison relative to a plurality of processing stations around the drum or belt. This rapid movement of the electrostatographic imaging surface has required vast amounts of toner to be used during development period. Thus, to produce high quality copies, a very efficient background removal apparatus or cleaning apparatus is necessary. Conventional cleaning devices have not been entirely satisfactory in this respect. Most of the known cleaning devices usually become less efficient as they become contaminated with toner, which cannot be removed, thus necessitating frequent replacement of the cleaning device. As a result, valuable time is lost during "down time" while a change is being made. Also, the cost of the cleaning device increases the per copy cost in such an apparatus. Other disadvantages with the conventional "web" type or the "brush" type cleaning apparatus are known to the art. Thus, there is a need for improved cleaning apparatus.

PRIOR ART STATEMENT

A number of patents disclose the so called magnetic brush cleaning system. See, e.g., U.S. Pat. Nos. 2,911,330, 3,580,673, 3,700,328, 3,713,736, 3,918,808, 4,006,987, 4,116,555, and 4,127,327. Briefly, in each of these patents there is disclosed a magnetic brush cleaning system in which a magnetic roller is mounted for rotation and located adjacent to the area of the photoreceptor surface to be cleaned. A quantity of magnetic carrier beads or particles are in contact with the magnetic roller and are formed into streamers or brush configuration. The magnetic roller supporting the brush may be connected to a source of DC potential to exert electrostatic attraction on the residual toner image to be cleaned. Thus, the magnetic brush removes toner from the imaging surface by mechanical, electrostatic as well as triboelectric forces.

In the magnetic brush cleaning devices of the prior art, the magnetic brush may be located either above the photoreceptor surface to be cleaned or it may be located elevationally at or below the photoreceptor. Compare FIGS. 1 and 2 of U.S. Pat. No. 2,911,330. When the magnetic brush is located elevationally at or below the photoreceptor surface area to be cleaned, a reservoir or sump for holding a supply of the magnetic carrier particles may be provided for the formation of the magnetic brush. The relatively large supply of carrier particles in the reservoir permits long operation before the carrier particles are substantially saturated with toner particles and can no longer efficiently clean the photoreceptor surface area. When the magnetic brush is located above the photoreceptor, the supply of carrier particles is essentially limited to those that are attached to the magnetic roller in the form of streamers, brush fibers or bristles. The relatively limited amount of carrier particles such an apparatus can hold limits the period of operation between servicing of the device, which involves removing the spent or used carrier particles and replenishing the magnetic roller with fresh carrier particles. Since in some of the newer copying machines, the period between service calls is already to some extent controlled by the cleaning devices, there is a need for efficient cleaning devices which have extended life between service calls.

Accordingly, it is an object of the present invention to provide a novel magnetic brush cleaning device which provides efficient cleaning during long periods of time between service calls, and which because of machine design and manufacturing constraints must be located at an elevation above the photoreceptor surface area to be cleaned. It is another object of the invention to provide a novel magnetic brush cleaning device which facilitates the removal of spent carrier particles and the reloading of fresh carrier particles during servicing. These and other objects of the invention will be apparent from the following disclosure.

SUMMARY OF THE INVENTION

In accordance with the present invention a magnetic brush cleaning device is provided which is capable of cleaning photoreceptor surfaces located at a lower elevation than the magnetic brush and yet has a relatively long operating life between service calls. In one embodiment, the magnetic brush cleaning apparatus comprises a magnetic brush roll having a plurality of magnet means mounted therein, a reservoir for carrier particles closely spaced from the magnetic brush roll, pickoff means for removing a part of the carrier particles constituting the magnetic brush during the rotation of the magnetic brush roll, and exit means at the lower end of the reservoir for directing the carrier particles onto the magnetic roll, so that the reservoir, the pickoff means, the exit means and the magnet means cooperate to cause the circulation of carrier particles between the magnetic brush roll and the reservoir whereby a portion of the magnetic brush is continuously removed and reformed during the rotation of the magnetic brush roll. In another embodiment, the reservoir, the pickoff means and the exit means are used only during servicing of the cleaning device. In this embodiment, the reservoir, the pickoff means and the exit means cooperate with the magnet means to remove the carrier particles from the magnetic brush roll and to reload the cleaning device with carrier particles.

DETAILED DESCRIPTION OF THE INVENTION

Figure 1:
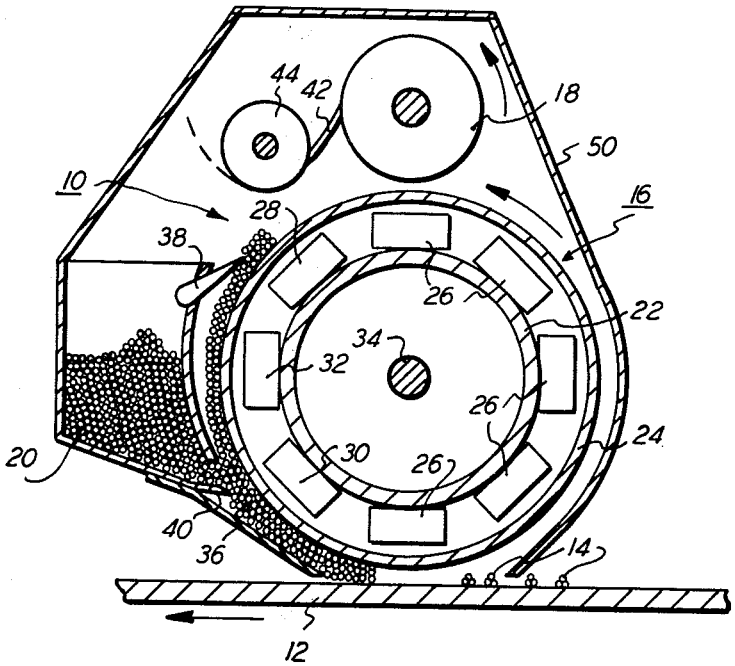
FIG. 1 shows a cross-sectional view of one embodiment of the magnetic brush cleaning apparatus of the present invention.

In FIG. 1, a magnetic brush cleaning apparatus 10 in accordance with the present invention is shown to be located above the photoreceptor surface 12 which is to be cleaned. The photoreceptor 12 has residual toner image areas 14 which must be cleaned before the photoreceptor can be used over again in the next copying cycle. The magnetic brush cleaning apparatus 10 is made of a brush roll 16, detoning roll 18 and a reservoir or sump 20 for the carrier beads.

The brush roll 16 is made of an inner sleeve or support 22 and an outer shell 24. The inner sleeve, which may conveniently be made of such ferro-magnetic materials as cold rolled steel has a number of magnets 26 fixedly mounted on its outer surface. In addition to magnets 26, there are provided a trim magnet 28, a sump exit magnet 30, and a sump magnet 32. The magnets 28,30, and 32 will be further described in detail below. The number of magnets mounted on the outside of sleeve 22 may be varied, but the total should be an even number such as six or eight or ten to facilitate the even distribution of the magnetic lines of force. Although the magnets 26 are shown to be separate magnets mounted on the outside of sleeve 22, it will be appreciated that a single magnitizable piece of material, sections of which may be alternately magnetized, may be used. The entire inner sleeve structure is mounted so as to be stationary during the operation of the magnetic brush cleaning apparatus.

The outer shell 24 is preferably concentric to the inner sleeve 22. Outer shell 24 is rotatably mounted on a shaft 34. On the exterior surface of the shell 24 brush fibers or streamers 36 are formed of carrier particles in the form of beads or powder.

The reservoir 20 for carrier particles has a pickoff means 38 and exit means 40 associated therewith. Pickoff means 38, which in its simplest form may be a doctor knife or scraper blade, may be integral with the reservoir 20 or it may be a separately formed member attached to the reservoir for convenient adjustment. Exit means 40 may conveniently be an opening at the bottom of the reservoir 20 with a baffle extending to a predetermined position to be described below.

The detoning roll 18, which removes toner from the magnetic brush fibers 36, is known in the art. See, e.g., the above cited U.S. Pat. No. 4,006,987. A scraper 42 removes the toner from the detoning roll 18 for disposal by transporting means 44.

Around the entire outside perimeter of the magnetic brush cleaning apparatus a shield 50 is provided to contain any stray carrier particles which may separate from the outer shell 24 due to the action of stationary magnetic lines of force on the rotating magnetic brush or streamers 36.

The brush roll 16 is generally biased with an appropriate source of DC potential, not shown, to assist the removal of the residual toner image 14 from the photoreceptor 12. Similarly, the detoning roll 18 is biased to exert electrostatic attraction on the toner attached to the magnetic brush on the brush roll 16. For example, with positively charged toner particles, the brush roll 16 may be biased to a potential of −200 volts with respect to ground, and the detoning roll may be biased to a potential −10 volts with respect to the brush roll 16.

Figure 2:
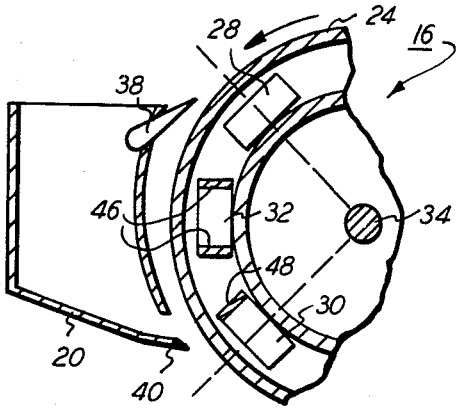
FIG. 2 shows a partial cross-sectional view of the apparatus of FIG. 1 in further detail.

Referring to FIG. 2, only some of the elements of the magnetic brush cleaning apparatus of FIG. 1 is shown, for clarity in discussion. In FIG. 2, the pickoff means 38 is shown to be off center laterally from the center line of the trim magnet 28. We have found that the tip of the pickoff means 38 is preferably located in the space between the center line of the trim magnet 28 and that end of the trim magnet closest to the sump magnet 32. We have found the best results, in terms of the desired compacted brush height of the magnetic brush, are achieved when the end of the pickoff means 38 is located within the space defined by the center line of the trim magnet 28 and its leading end. Although we do not wish to be bound by any scientific explanation for this result, it appears that the magnetic lines of force in this space are in such a configuration that they aid in the removal of carrier particles from the brush and thus permits more renewal of the brush during each rotation.

In a similar manner we have found that the end of the exit means 40 of the reservoir 20 should be located in the space defined by the center line of the sump exit magnet 30 and the end of magnet 30 nearest the sump magnet 32. We have found that the location of the end of exit means 40 in this space permits the best control of the resultant compacted brush height.

Both the end of the pickoff means 38 and the end of exit means 40 should be spaced from the brush roll 16 at a distance within about 30 percent of the desired compacted brush height of the magnetic brush. The compacted brush height is defined as the height of the magnetic brush, after the brush has been compacted by pressure. The pickoff means 38 should be so positioned as to remove about 20 to 100 percent of the carrier particles forming the magnetic brush fibers 36 during each revolution of the outer shell 24. Preferably, pickoff means 38 removes about 30 to 70 percent of such carrier particles, and we particularly prefer the removal of about 5 percent of such carrier particles.

The sump magnet 32 is provided to stabilize the magnetic brush formed on the brush roll 16. Preferably the sump magnet 32 has a bar of a ferro-magnetic material 46 attached to the non-polar ends of the sump magnet 32. Similarly, sump exit magnet 30 may advantageously have a bar of ferro-magnetic material 48 at its end nearest the sump magnet 32. The bars of ferro-magnetic material 46 and 48 behave in the nature of a shunt for the magnetic lines of force, to prevent the magnets from holding the carrier particles onto the wall of the reservoir 20 by magnetic force.

In operation, the magnetic brush bristles 36 are fully formed in the vicinity of sump exit magnet 30, and they contact and clean the photoreceptor 12. Upon rotation to the area of the trim magnet 28, the magnetic brush bristles 36 are partially trimmed or removed by the pickoff means 38 but they are renewed by carrier particles from the sump 20 through exit means 40 and are again fully formed.

The pickoff means 38, sump 20 and exit means 40 may be used in the servicing of the magnetic brush cleaning device to aid the removal of spent carrier particles and the reloading of fresh carrier particles. Thus, the sump 20 may be slidably mounted so that it can be slid out and the carrier particles therein removed. Then the sump 20 may be re-inserted and pickoff means 38 adjusted to scrape off substantially all the carrier particles on the outer shell 24. Means, not shown, may be provided to prevent the removed carrier particles from returning to the outer shell 24 to reform magnetic brush bristles 36. After the scraped off carrier particles are also removed from the sump 20, fresh carrier particles may be added to the sump and new magnetic brush fibers formed. This servicing function may be performed by the pickoff means 38, sump 20 and exit means 40 even if they are not used in the normally operation of the magnetic brush cleaning device—that is, even when the pickoff means 38 is normally pivoted away from outer shell 24 and when the sump 20 does not hold any carrier particles so that they do not partially remove and reform the magnetic brush bristles during rotation of the outer shell 24. In such a device, the magnetic brush bristles are captively formed on outer shell 24 and are used in cleaning operation until spent. At that time, an operator can adjust the pickoff means 38 to substantially completely scrape off the captive brush fibers into sump 20 and there removed from the copying machine and replaced by fresh carrier particles. In such mode of operation, the pickoff means 38, sump 20 and exit means 40 facilitate the servicing of the magnetic brush cleaning device.

While the invention has been described in detail with reference to specific and preferred embodiments, it will be appreciated that various modifications may be made from the specific details without departing from the spirit and scope of the invention. For example, the pickoff means 38 can be in the form of a transport roll, positioned above the brush roll 16, to remove the carrier particles from the brush roll 16. The carrier particles are then removed from the transport roll into the reservoir 20. Similarly, other modifications from the specific embodiments disclosed herein can be made by those skilled in the art.

What is claimed is:

1. A magnetic brush apparatus for cleaning the photoreceptor in an electrostatographic copying machine comprising a magnetic brush roll positioned at an elevated location from the area of the photoreceptor to be cleaned by the brush, a plurality of magnet means located inside said magnetic brush roll, a reservoir for carrier particles, pickoff means for removing a part of the carrier particles from said magnetic brush roll into said reservoir during rotation of said magnetic brush roll, and exit means at the lower end of said reservoir, whereby said reservoir, said pickoff means, said exit means and said magnet means cooperate during the operation of the apparatus to circulate the carrier particles between the magnetic brush roll and the reservoir so that a portion of the magnetic brush on the roll is continuously removed and reformed, said magnetic brush roll comprises an inner stationary support and an outer roll mounted for rotation, said magnet means being fixedly mounted on said inner support and said outer roll being concentric to said inner support so that magnetic brush formed of carrier particles is supported on the exterior cylindrical surface of the outer roll, said magnet means includes a first magnet means positioned near said pickoff means to assist in the partial removal of the magnetic brush during the operation of the apparatus, a second magnet means positioned near said exit means to assist in the reformation of the magnetic brush during the operation of the apparatus, and a third magnet means positioned between said first and second magnet means, said second and third magnet means include magnetic field shunting means to prevent the magnetic fields from said second and third magnet means for interfering with the flow of the carrier particles in said reservoir.

2. A magnetic brush apparatus of claim 1 wherein said pick-off means comprises a trim blade laterally positioned between the center line of the first magnet means and the end of the first magnet means nearest the third magnet means, said trim blade being spaced from said magnetic brush roll by a distance which is within about 30% of the desired compacted brush height.

3. A magnetic brush apparatus of claim 2 wherein said pickoff means is positioned to remove about 50 percent of the carrier particles forming the magnetic brush during each revolution of the magnetic brush roll.

* * * * *